United States Patent [19]

Gervais

[11] Patent Number: 4,896,665

[45] Date of Patent: Jan. 30, 1990

[54] RESPIRATORY PROTECTION HOOD AND SAFETY EQUIPMENT FOR AIRCRAFT

[75] Inventor: Pierre P. Gervais, Seyssins, France

[73] Assignee: l'Air Liquide, Societe Anonyme pour l'Etude et l'Exploitation des Procedes Georges Claude, Paris, France

[21] Appl. No.: 252,137

[22] Filed: Oct. 3, 1988

[30] Foreign Application Priority Data

Oct. 2, 1987 [FR] France ..... 87 13610

[51] Int. Cl.[4] ..... A62B 7/10; A62B 17/04; A62B 18/00

[52] U.S. Cl. ..... 128/201.25; 128/201.22; 128/205.12; 128/205.27

[58] Field of Search ..... 128/201.22, 201.23, 128/201.24, 201.25, 204.18, 205.25, 205.27, 205.28, 205.12

[56] References Cited

U.S. PATENT DOCUMENTS

| | | | |
|---|---|---|---|
| 3,762,407 | 10/1973 | Shonerd | 128/201.23 |
| 4,032,991 | 7/1977 | Vandeweghe | 128/201.25 |
| 4,057,058 | 11/1977 | Kovacevic | 128/201.23 |
| 4,236,514 | 12/1980 | Moretti | 128/201.23 |
| 4,440,164 | 4/1984 | Werjefelt | 128/205.25 |
| 4,481,945 | 11/1984 | Levine | 128/205.25 |
| 4,552,140 | 11/1985 | Cowley et al. | 128/201.25 |
| 4,559,939 | 12/1985 | Levine et al. | 128/205.25 |
| 4,620,538 | 11/1986 | Koegel et al. | 128/201.23 |
| 4,710,756 | 12/1987 | Thornburg et al. | 128/201.23 |
| 4,754,751 | 7/1988 | Mausteller et al. | 128/201.25 |
| 4,757,813 | 7/1988 | Haydu | 128/201.23 |
| 4,766,893 | 8/1988 | Drews | 128/204.18 |
| 4,793,342 | 12/1988 | Haber et al. | 128/205.25 |

FOREIGN PATENT DOCUMENTS

| | | | |
|---|---|---|---|
| 0194657 | 9/1986 | European Pat. Off. | 128/201.25 |
| 3138697 | 4/1983 | Fed. Rep. of Germany | 128/201.25 |
| 857298 | 9/1940 | France | 128/201.25 |
| 2582524 | 12/1986 | France . | |
| 324909 | 1/1930 | United Kingdom | 128/201.25 |
| 2191099 | 12/1987 | United Kingdom | 128/201.23 |

*Primary Examiner*—David A. Wiecking
*Assistant Examiner*—Kimberly L. Asher
*Attorney, Agent, or Firm*—Young & Thompson

[57] ABSTRACT

The hood (1) comprises a fluidtight flexible cover (5) forming a cap and provided at its base with a closed C-shaped tube (2) constituting a reserve of oxygen under pressure. The ends of the C are interconnected by a normally convex spring strip (3) which is capable of being withdrawn within the confines of the C to permit the stowing away of a plurality of hoods in a box of small size. Application in the safety of aircraft passengers.

16 Claims, 2 Drawing Sheets

RESPIRATORY PROTECTION HOOD AND SAFETY EQUIPMENT FOR AIRCRAFT

The present invention relates to a respiratory protection hood of the type comprising a sealed flexible cover adapted to cover the head of the bearer and provided at its base with a shape-maintaining element closed onto itself and disposed, in service, around the neck of the bearer, a reserve of oxygen under pressure, means for putting the interior of said reserve in communication with the interior of the cover, and flexible sealing means for connecting the hood to the neck of the bearer.

The document EP-A-223 808 of the applicant discloses a protection hood of this type in which the oxygen reserve is formed by a roughly toric tube almost closed onto itself and constituting the shape-maintaining element. This arrangement, which is perfectly adapted to the protection of the flight personnel of the aircraft, is difficult to extend to the protection of passengers, since the size of the hood in the folded state is excessive relative to the space usually available in airline craft.

An object of the invention is to provide a protection hood which may be stowed away in a much smaller space.

The invention therefore provides a protection hood of the aforementioned type, wherein said element is at least partly constituted by a deformable means which is capable of assuming either a convex shape or a concave shape.

According to advantageous features of the invention:

said element comprises a C-shaped tube constituting said oxygen reserve whose two ends are interconnected by said deformable means;

the deformable means is a normally convex spring strip;

the hood comprises a $CO_2$ absorbing device which preferably forms a rigid cartridge including an appendix adapted, when the hood is passed over the head, to automatically put the interior of the tube in communication with the interior of the cover.

The invention also provides safety equipment for aircraft which comprises a box in which are stacked a plurality of hoods such as defined hereinbefore, the tubes being disposed so that the ends of each tube extend in a direction opposite the direction in which the ends of each adjacent tube extend, the flexible means having their concave shape when the hoods are stacked inside the box.

An embodiment of the invention will now be described with reference to the accompanying drawings, in which.

Figure 1:
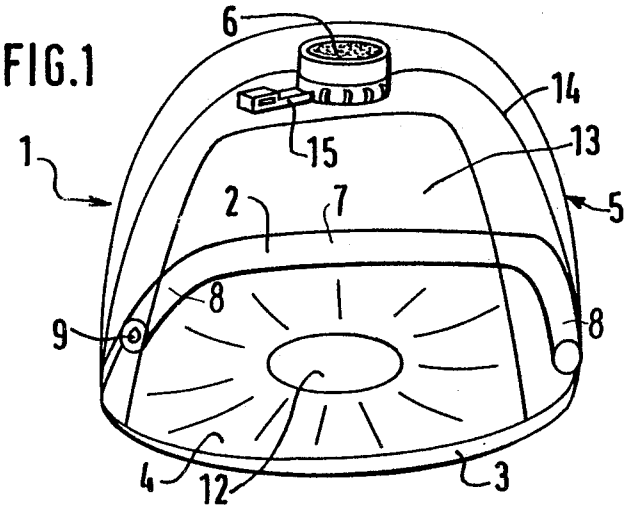
FIG. 1 is a perspective view of a hood according to the invention in its position of use.
Figure 4:
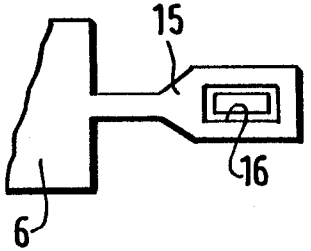
FIG. 4 is a view of a detail of FIG. 2 in the direction of arrow IV of FIG. 2.

The hood shown in FIG. 1 comprises a reserve 2 of oxygen, a bow member 3, a sealing diaphragm 4, a double cover 5, and an absorbent cartridge 6.

Figure 2:
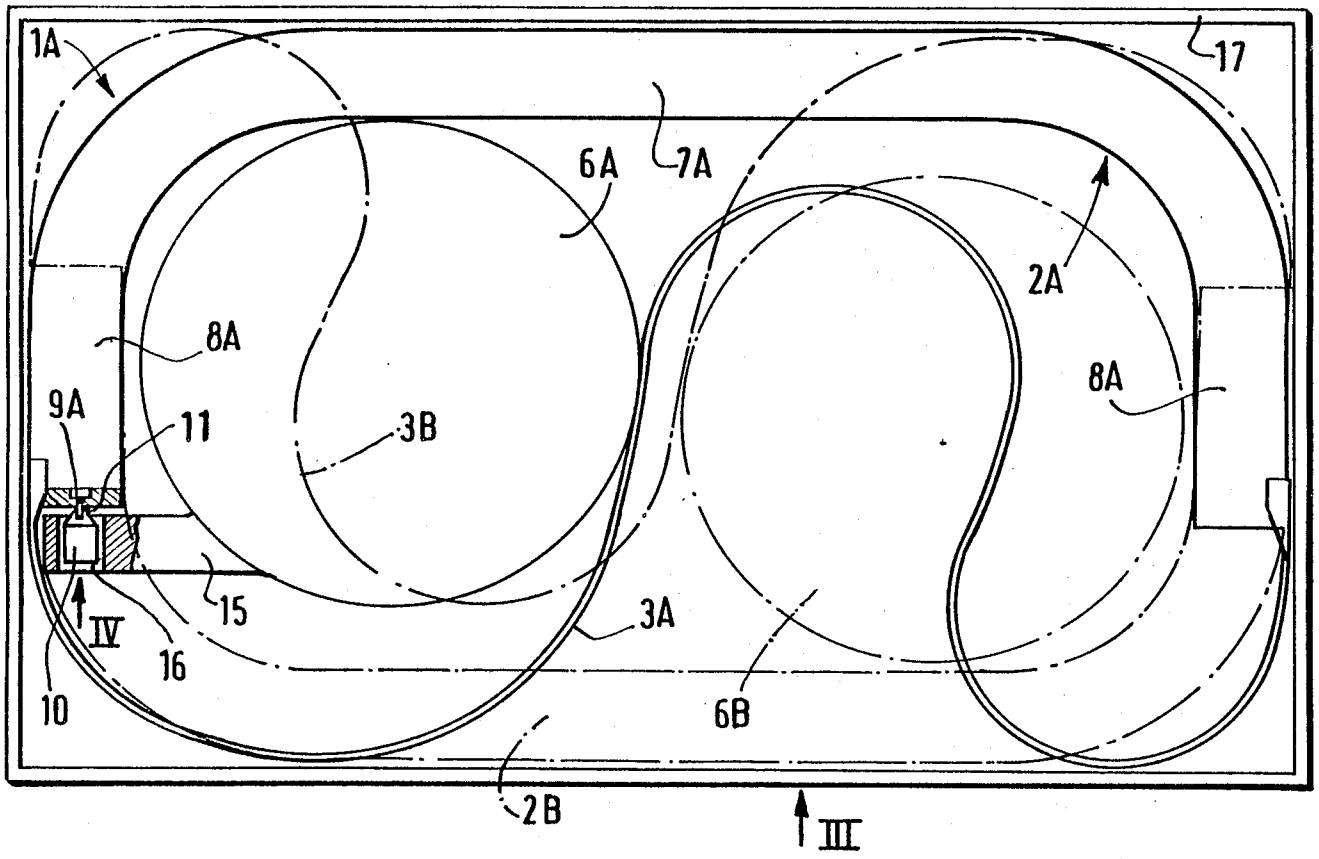

As can be seen in FIGS. 1 and 2, the oxygen reserve is formed by a C-shaped tube comprising a rectilinear central portion 7 connected by radiused portions to two end portions 8 which are also rectilinear, so that the C forms a semi-rectangle with rounded corners. The ends of the C are closed by front discs one of which has a calibrated orifice 9 which is open when the hood is in use (FIG. 1) but closed before this use by a plug 10 having a rectangular section and connected to the corresponding disc by a breaking region 11 (FIG. 2). The tube 2 initially contains oxygen under pressure, for example under a pressure of about 150 bars.

The bow member 3 is a spring strip which is of metal or plastics material, interconnects the two ends of the C and is fixed to the outer side of these ends. This bow member is normally convex in shape, i.e. it forms with the tube 2 a roughly circular periphery, but it may also assume a relatively stable concave configuration in which it is withdrawn into the interior of the C of the tube 2 (FIG. 2).

The diaphragm 4 is secured in a sealed manner to the tube 2 and to the bow member 3 and defines a central opening 12 allowing the passage of the head of a person.

The double cover 5 is made from a film of transparent plastics material. It comprises a front side 13 in a single thickness, constituting a vision window, whose base is connected to the median portion of the bow member 3, and two caps fitted one inside the other whose edges are fixed together, on one hand, along the edge of the window 13 and, on the other hand, along the lateral portions of the bow member 3 and along the tube 2. The inner cap 14 has at its top an orifice in which the cartridge 6 is mounted.

The cartridge 6 contains an absorbent of $C_2$, for example lime containing soda. It has a generally cylindrical shape and is permeable to gases in the axial direction, so that the gas can pass freely from the interior of the cap 14 to the space between the two caps, and inversely, but solely through the cartridge 6. Furthermore, the cartridge 6 includes a rigid lateral appendix 15 provided with an end aperture 16 having a rectangular section conjugate with that of the plug 10 of the tube 2.

Figure 3:
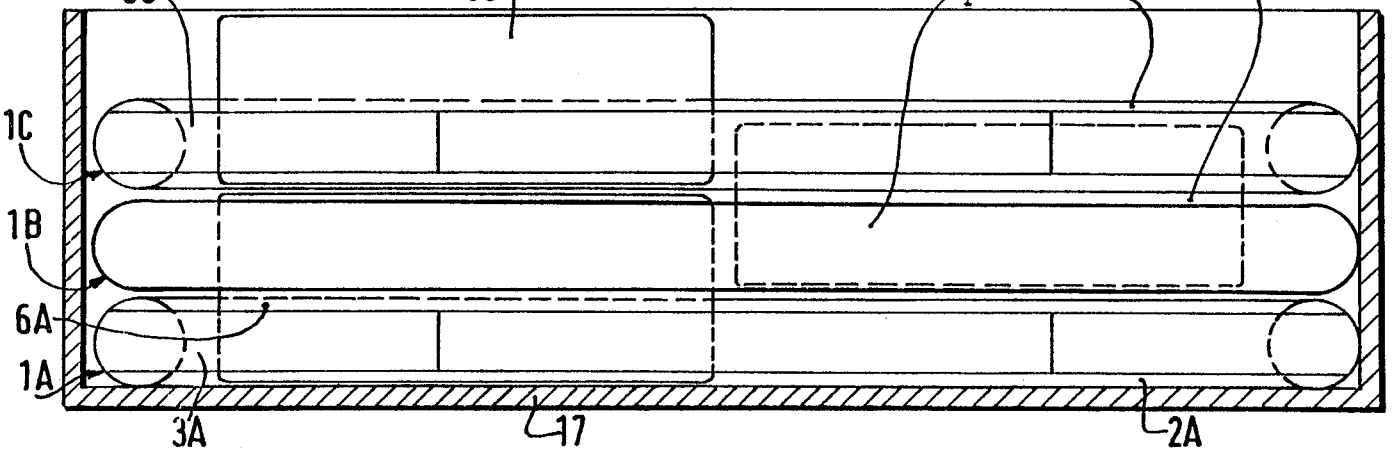
FIGS. 2 and 3 are respectively a plan view and an elevational view in the direction of arrow III of FIG. 2, of safety equipment according to the invention containing three hoods such as that shown in FIG. 1.

FIGS. 2 and 3 show how a plurality of hoods 1 (three in number and carrying the reference numerals 1A, 1B, 1C in the considered embodiment) which may be stowed away in a box 17 of small dimensions, in particular intended to be placed in the prescribed space above a row of passenger seats of an aircraft. In FIG. 2, there is shown in solid line the lower hood 1A, and diagrammatically indicated in dot/dash line, the hood located immediately above. Each element of each hood seen in FIGS. 2 and 3 carries a reference numeral similar to that in FIG. 1, but with the suffix A, B or C.

The box 17 is parallel-sided and. When viewed in plan (FIG. 2), its length is slightly greater than the largest dimension of the C formed by the tube 2 and its width is between one and two times the smallest dimension of the C. The three hoods 1A to 1C are stowed away in this box in the following way.

In respect of each hood, the aperture 16 is mounted on the plug 10 so that the cartridge 6 is located in a corner of the C. As viewed in elevation (FIG. 3), its lower side is flush with the lower generatrix of the tube 2 while its upper side distinctly projects above this tube. The bow member 3 is put into its concave configuration and its intermediate portion is disposed in the free corner of the C. The double cover is folded and occupies a very small amount of space.

The lower hood 1A is placed on the bottom of the box 17 with for example its cartridge 6A on the left side. The intermediate hood 1B is placed on the hood 1A with its tube 2B disposed in reversed relation to the tube 2A of the hood 1A. Consequently its cartridge 6B is located on the right side and does not overlap the cartridge 6A. Lastly, the upper hood 1C is placed on the hood 1B in the same position as the lower hood 1A.

In this way, the cartridge 6C is directly superimposed on the cartridge 6A, the sum of their heights substantially corresponding to the height of the box 17, and the cartridge 6B is located at an intermediate level, as shown in FIG. 3.

In the case where the assembly 17-1A-1B-1C forms safety equipment for a row of three passengers of an aircraft, the box 17 is disposed in an inverted position and provided with an openable lower lid (not shown). When this lid is opened, the three hoods fall from the box and, under the effect of the resulting impact, the bow member 3 can possibly return to its convex shape on its own or may be brought to this position manually. The user then passes his head through the opening 12 of the diaphragm 4 and, in doing so, urges the cartridge 6 in the upward direction. This causes the rotation of the appendix 15 and the breaking of the region 11 of the plug 10 and, at the same time, the spreading out of the double cover 5.

Consequently, the bearer or user of the hood has his head completely surrounded by the hood, the seal in the region of his neck being ensured by the flexible diaphragm 4 and the oxygen necessary for his breathing is supplied in the inner cap 14 at a rate of flow determined by the calibrated orifice 9.

The two caps one within the other thus delimit between themselves two compartments, namely, an internal compartment in which is disposed the head of the wearer, and an external compartment of variable volume which provides a rebreathing capability to the helmet. Specifically, thanks to this arrangement, the gas is continuously passed, during the breathing of the wearer of the helmet, alternately in one direction and the other, between those two compartments, passing through the bed of absorbent material contained in the cartridge 6. During expiration, the gases pass from the internal compartment to the external compartment, and during inhalation the circulation of the gases is in the opposite direction. Thus the gases permanently lose exhaled impurities and particularly carbon dioxide. The wearer of the protective helmet according to the invention may thus breathe in a closed circuit with only a small oxygen replenishment. Thus, the fact that there is a relatively small amount of oxygen available in the tube 2 is of no consequence, since the passengers of an aircraft remain seated and therefore consume little oxygen, in contrast to the flight personnel. For the same reason, a single absorbent cartridge is sufficient.

Figure 5:
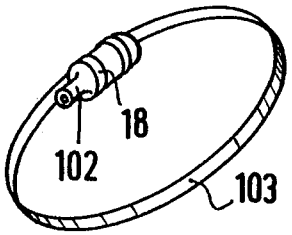
FIG. 5 is a partial view of another embodiment of the hood according to the invention.

In another embodiment shown in FIG. 5, the element for maintaining the shape of the hood is no longer constituted by the assembly 2-3 of FIG. 1 but by a spring strip 103 closed onto itself. A cylinder or flask 102 constituting the reserve of oxygen under pressure is fixed to the inner side of this strip 103. The fixing may be achieved by any suitable means, for example by straps 18. As before, the strip 103 may assume either the roughly circular convex shape shown in FIG. 5 when the hood is in service, or a concave shape enabling it to be stowed away in a small space as in FIG. 2.

I claim:

1. A hood for respiratory protection comprising a fluidtight flexible cover for covering the head of a user and having a base secured to a shape-maintaining device which is closed onto itself for being placed, in service, around the neck of the user, said device having first overall dimensions in service, when viewed in plain view, a reserve of oxygen under pressure, means for putting the interior of the reserve in communication with the interior of the cover, and flexible sealing means for connecting the hood to the neck of the user, at least a part of the circumference of said shape-maintaining device being constituted by a normally convex spring strip which is capable of assuming selectively a convex shape and a concave shape, said device, when said spring strip assumes its concave shape, having second overall dimensions substantially smaller than said first overall dimensions.

2. A hood according to claim 1, comprising a device for absorbing $CO_2$ which communicates with the interior of the cover.

3. A hood according to claim 2, wherein the device for absorbing $CO_2$ is located at the top of the cover.

4. A hood according to claim 2, wherein the device for absorbing $CO_2$ comprises a rigid cartridge having an appendix capable of automatically putting the interior of the reserve in communication with the interior of the cover when the hood is placed on the head of the user.

5. A hood according to claim 2, wherein the cover defines an opening through which the device for absorbing $CO_2$ extends and the hood further comprises a second flexible cover outside the first-mentioned cover and connected in a sealed manner to the first-mentioned cover along edges of said covers.

6. Safety equipment for an aircraft, comprising a box and a plurality of hoods for respiratory protection stacked inside the box, each hood comprising a fluidtight flexible cover for covering the head of a user and having a base provided with a shape-maintaining device which is closed onto itself and is for placing, in service, around the neck of the user, a reserve of oxygen under pressure, means for putting the interior of the reserve in communication with the interior of the cover, and flexible sealing means for connecting the hood to the neck of the user, said shape-maintaining device comprising a C-shaped tube constituting said reserve of oxygen and having two end portions, and a deformable means which is capable of assuming selectively a convex shape and a concave shape and interconnects said two end portions of the tube, said deformable means, in said concave shape, being withdrawn within the confines of the C-shaped tube, the tubes being disposed so that said end portions of each tube extend in a direction opposite the direction in which said end portions of each adjacent tube extend, the flexible means having said concave shape when said hoods are stacked inside said box.

7. Equipment according to claim 6, wherein the C-shaped tube of each hood has the shape of a semi-rectangle with rounded corners.

8. Equipment according to claim 6, wherein the deformable means of each hood is a normally convex spring strip.

9. Equipment according to claim 6, comprising for each hood a device for absorbing $CO_2$ which communicates with the interior of the cover.

10. Equipment according to claim 9, wherein the device for absorbing $CO_2$ of each hood is located at the top of the cover of the respective hood.

11. Equipment according to claim 9, wherein the cover of each hood defines an opening through which opening the device for absorbing $CO_2$ extends and each hood further comprises a second flexible cover outside the first-mentioned cover and connected in a sealed manner to the first-mentioned cover along edges of said covers.

12. Equipment according to claim 11, wherein the device for absorbing $CO_2$ of each hood comprises a rigid cartridge having an appendix capable of automatically putting the interior of the respective tube in communication with the interior of the respective cover when the hood is placed on the head of the user.

13. Equipment according to claim 12, wherein the C-shaped tube has substantially the shape of a semi-rectangle with rounded corners and the cartridges of the hoods are disposed alternately in opposed rounded corners of the C-shaped tubes so that, when viewed in plan, the cartridges of any two immediately superimposed hoods do not overlap each other.

14. Safety equipment for an aircraft, comprising a box and a plurality of hoods for respiratory projection stacked inside the box, each hood comprising a fluidtight flexible cover for covering the head of a user and having a base secured to a shape-maintaining device which is closed onto itself for being placed, in service, around the neck of the user, said device having first overall dimensions in service, when viewed in plan view, a reserve of oxygen under pressure, means for putting the interior of the reserve in communication with the interior of the cover, and flexible sealing means for connecting the hood to the neck of the user, at least a part of the circumference of said shape-maintaining device being constituted by a normally convex spring strip which is capable of assuming selectively a convex shape and a concave shape, the flexible means of each hood having said concave shape, said device, when said spring strip assumes its concave shape, having second overall dimensions substantially smaller than said first overall dimensions.

15. A hood for respiratory protection comprising a fluidtight flexible cover for covering the head of a user and having a base provided with a shape-maintaining device which is closed onto itself for being placed, in service, around the neck of the user, a reserve of oxygen under pressure, means for putting the interior of the reserve in communication with the interior of the cover, and flexible sealing means for connecting the hood to the neck of the user, at least a part of said shape-maintaining device comprising a deformable means which is capable of assuming selectively a convex shape and a concave shape, said shape-maintaining device further comprising a substantially C-shaped tube constituting said reserve of oxygen, the tube having two end portions which are interconnected by said deformable means, said deformable means, in said concave shape, being withdrawn within the confines of the C-shaped tube.

16. A hood according to claim 15, wherein the C-shaped tube has the shape of a semi-rectangle with rounded corners.

* * * * *

UNITED STATES PATENT AND TRADEMARK OFFICE

CERTIFICATE OF CORRECTION

PATENT NO. : 4,896,665

DATED : January 30, 1990

INVENTOR(S) : Pierre PELLOUX-GERVAIS

It is certified that error appears in the above—identified patent and that said Letters Patent is hereby corrected as shown below:

Change the name of the inventor, From "Pierre P. Gervais", in Item 75, to --Pierre Pelloux-Gervais--.

Also, immediately below line 19, change "Gervais" to --Pelloux-Gervais--.

Signed and Sealed this

First Day of January, 1991

*Attest:*

HARRY F. MANBECK, JR.

*Attesting Officer*

*Commissioner of Patents and Trademarks*